US010612274B2

(12) United States Patent
Kuehn et al.

(10) Patent No.: US 10,612,274 B2
(45) Date of Patent: Apr. 7, 2020

(54) THERMALLY ACTUATED DRYER DOOR LOCK

(71) Applicant: ILLINOIS TOOL WORKS INC., Glenview, IL (US)

(72) Inventors: Kurt A. Kuehn, Des Plaines, IL (US); Karl S. Morgan, Des Plaines, IL (US); Michael W. Davis, Elburn, IL (US); Richard R. Herzog, Arlington Heights, IL (US); Chong B. Wong, Vernon Hills, IL (US); Robert Dam, Aurora, IL (US); John G. Drelicharz, Davis, IL (US)

(73) Assignee: Illinois Tool Works Inc., Glenview, IL (US)

( * ) Notice: Subject to any disclaimer, the term of this patent is extended or adjusted under 35 U.S.C. 154(b) by 179 days.

(21) Appl. No.: 14/377,186

(22) PCT Filed: Feb. 7, 2013

(86) PCT No.: PCT/US2013/025125
§ 371 (c)(1),
(2) Date: Aug. 7, 2014

(87) PCT Pub. No.: WO2013/119795
PCT Pub. Date: Aug. 15, 2013

(65) Prior Publication Data

US 2015/0013998 A1 Jan. 15, 2015

Related U.S. Application Data

(60) Provisional application No. 61/597,296, filed on Feb. 10, 2012.

(51) Int. Cl.
*E05B 65/10* (2006.01)
*D06F 58/28* (2006.01)
(Continued)

(52) U.S. Cl.
CPC ..... *E05B 65/104* (2013.01); *A62C 2/04* (2013.01); *A62C 3/14* (2013.01); *D06F 39/14* (2013.01);
(Continued)

(58) Field of Classification Search
CPC ..... Y10T 292/0969; Y10T 292/0997; Y10S 292/65; Y10S 292/66; Y10S 292/69;
(Continued)

(56) References Cited

U.S. PATENT DOCUMENTS 3,325,941 A * 6/1967 Prucha ..... E06B 5/164 187/314
4,161,804 A * 7/1979 D'Hooge ..... A62C 2/12 16/48.5
(Continued)

FOREIGN PATENT DOCUMENTS

AT 403498 B * 2/1998 ..... E06B 3/827
CA 2538437 A1 * 9/2006 ..... E05B 65/104
(Continued)

OTHER PUBLICATIONS

Machine translation of DE 3315351; 8 pages (Year: 2019).*
ISR and WO for PCT/US2013/025125 dated Jul. 10, 2013.

*Primary Examiner* — Christine M Mills
(74) *Attorney, Agent, or Firm* — Boyle Fredrickson, S.C.

(57) ABSTRACT

A thermally actuated lock for an appliance incorporates a fusible material that holds a spring-loaded bolt in retraction. Temperatures that would indicate an appliance fire allow the bolt to extend between the housing and appliance door to lock the appliance door in a closed position.

13 Claims, 5 Drawing Sheets

(51) Int. Cl.

| | |
|---|---|
| ***D06F 58/20*** | (2006.01) |
| ***D06F 39/14*** | (2006.01) |
| ***A62C 2/04*** | (2006.01) |
| ***A62C 2/06*** | (2006.01) |
| *D06F 37/42* | (2006.01) |

(52) U.S. Cl.
CPC ..... *D06F 58/20* (2013.01); *D06F 58/28* (2013.01); *D06F 37/42* (2013.01); *D06F 2058/2858* (2013.01)

(58) Field of Classification Search
CPC .... E05B 65/104; E05B 47/0009; E05B 15/16; A62C 3/14; A62C 2/04; D06F 39/14; D06F 37/42
USPC ... 292/163, 175, DIG. 65, DIG. 66, DIG. 69
See application file for complete search history.

(56) References Cited

U.S. PATENT DOCUMENTS 4,183,565 A * 1/1980 Allemann ..... E05B 65/104 292/150
4,259,656 A * 3/1981 Smith ..... H01H 37/765 337/403
4,272,111 A * 6/1981 Hammer, Jr. ..... D06F 37/28 292/17
4,714,285 A * 12/1987 Langham ..... E05B 65/104 292/163
5,121,950 A * 6/1992 Davidian ..... E05B 65/104 292/164
5,380,053 A * 1/1995 Saino ..... E05B 65/104 292/144
5,782,509 A * 7/1998 Uyeda ..... E05B 65/104 292/341.17
6,047,486 A * 4/2000 Reck ..... D06F 39/005 34/491
7,488,012 B2 * 2/2009 Eller ..... E05B 63/18 292/137
8,191,939 B2 * 6/2012 Lin ..... E05B 65/104 292/1
8,979,143 B1 * 3/2015 Lin ..... E05B 17/2034 292/153
2005/0284030 A1 * 12/2005 Autovino ..... E05B 65/104 52/1
2009/0241368 A1 * 10/2009 Gielda ..... D06F 58/28 34/544
2013/0119679 A1 * 5/2013 Rocchitelli ..... E05C 1/004 292/164
2013/0193818 A1 * 8/2013 Sturm ..... A62C 2/242 312/222
2014/0159394 A1 * 6/2014 Promutico ..... D06F 37/28 292/341.16

FOREIGN PATENT DOCUMENTS

DE 2638168 A1 * 3/1978 ..... E04B 1/941
DE 3239177 A1 * 5/1984 ..... E05B 65/104
DE 3315351 A1 * 10/1984 ..... E05B 65/104
DE 102005009995 A1 * 9/2006 ..... E05B 47/0046
DE 102005009996 A1 * 9/2006 ..... E05B 65/104
EP 0651126 A1 * 5/1995 ..... E06B 5/16
EP 1176277 A1 * 1/2002 ..... E05B 65/104
EP 1531218 A1 * 5/2005 ..... E05B 53/003
EP 1707714 A2 10/2006
KR 20100110424 A * 10/2010 ..... E05B 65/104
WO 2011/139506 A1 11/2011

* cited by examiner

THERMALLY ACTUATED DRYER DOOR LOCK

CROSS REFERENCE TO RELATED APPLICATION

This application is a national phase of International Application Number PCT/US2013/025125 filed Feb. 7, 2013, which claims the benefit of U.S. provisional application 61/597,296 filed Feb. 10, 2012 and hereby incorporated in its entirety by reference.

FIELD OF THE INVENTION

The present invention relates to clothes dryers and the like and specifically to a lock assembly for preventing opening of the dryer door in the event of a dryer fire.

BACKGROUND OF THE INVENTION

Clothes dryers typically provide a rotating drum perforated with openings to allow forced airflow through the drum walls while the clothes are tumbled within the rotating drum. The drum is normally held within an appliance housing to rotate along a horizontal axis to promote tumbling action while the drum opening is covered by a housing door to retain the clothes therein. The forced air through the drum walls may be heated by an electrical or gas heating element to increase the drying capacity of that air. Humid air, after passing through the clothing, is normally exhausted out of the dryer through an exhaust duct leading outside of the home or building.

Clothing dried in this manner will often release fabric threads and the like which form combustible lint which may be trapped in a lint screen to be periodically cleaned by the user. The presence of heated air and the combustible material of the lint, the latter of which may accumulate throughout the dryer particularly if the lint filter is not cleaned or replaced, and/or the cleaning of clothes containing combustible fluids can on rare occasions cause a dryer fire in which materials within the dryer begin to burn.

SUMMARY OF THE INVENTION

The present invention provides a thermally actuated door lock which will hold the dryer door closed in the event of a dryer fire, counteracting any tendency of the user to open the door, which may promote the fire (by providing a source of air to the fire through the open door) and which may expose the user to possible personal injury and/or increase damage to the building from smoke and flame passing out of the open door. Additionally, the thermally actuated door lock may help prevent the door from being blown open in the case of explosive combustion that may occur when smoldering materials ignite a gas build up within the dryer drum. In one embodiment, the thermally actuated door lock is activated at combustion temperatures by a melting of a fusible material holding a spring-loaded bolt in retraction when the fusible material melts; a released spring-loaded bolt may then engage the door to prevent it from opening.

Specifically, in one embodiment, the present invention provides an appliance lock having a housing with an opening at a first end and a base at a second end. A bolt is slidably received within the housing to move between an extended position where the bolt protrudes out from the opening, and a retracted position where the bolt is substantially fully received within the housing. A spring biases the bolt toward the extended position. A fusible material operates in a solid state to join the bolt to the housing when the bolt is in the retracted position where the fusible material has a melting point of above 170 degrees Fahrenheit.

It is thus a feature of at least one embodiment of the invention to provide for an appliance lock that discourages the user from accessing the interior of an appliance at temperatures above the normal interior temperatures, indicating a possible fire.

The appliance lock bolt may have a thickness greater than 0.02 inches.

It is thus a feature of at least one embodiment of the invention to provide sufficient lateral resistance against an opening of the appliance door when there is a fire and to help resist melting of the bolt at fire temperatures.

The appliance lock bolt may be composed of metal.

It is thus a feature of at least one embodiment of the invention to provide a bolt with high strength at high temperatures to withstand opening of the appliance door when there is a fire.

The housing may have a radially extending flange surrounding the opening at the first end adapted to be retained against the rim of a hole near the door of an appliance through which the housing passes to block movement of the housing toward the second end.

It is thus a feature of at least one embodiment of the invention to provide simplified installation of the thermally actuated lock into a pre-existing mounting hole and to provide a structure that will maintain the housing against the hole without allowing it to slide through.

The lock may have a retainer element fitting over an outer surface of the housing to slide toward the rim to retain the housing attached to the appliance, the material of the hole flanked on opposite surfaces by the rim and retainer.

It is thus a feature of at least one embodiment of the invention to provide stability in the mounting of the housing against the appliance in a way that permits rapid installation of the thermally actuated lock.

The retainer element may have spring-biased cantilevered teeth allowing it to slide over the outer surface of the housing toward the rim but to resist sliding over the outer surface away from the rim.

It is thus a feature of at least one embodiment of the invention to provide a rapid installation fastener that resists dislodgment.

The end of the bolt toward the base may have an axially extending boss with a diameter less than the bolt, and the boss may be received within a rearward-extending pocket to be retained therein by the fusible material.

It is thus a feature of at least one embodiment of the invention to reduce the amount of fusible material both allowing it to melt faster and reducing the cost of the lock.

The spring may be a compression spring fitting coaxially around the bolt and positioned between the base and capture elements extending radially from the bolt.

It is thus a feature of at least one embodiment of the invention to provide a simple and reliable means to bias the bolt toward the extended position.

Other features and advantages of the invention will become apparent to those skilled in the art upon review of the following detailed description, claims and drawings in which like numerals are used to designate like features.

Figure 1:
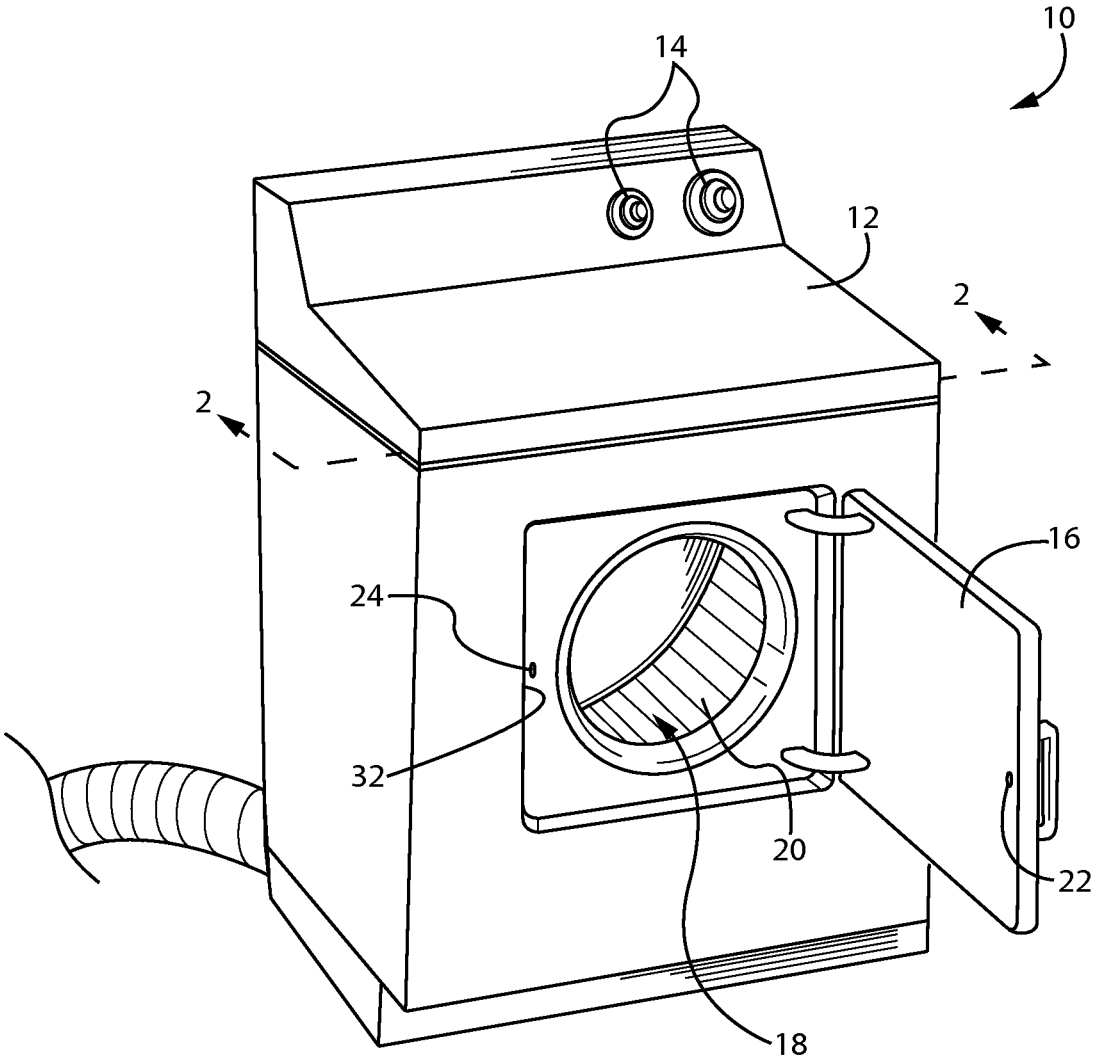
FIG. 1 is a simplified perspective view of a conventional dryer suitable for use with the present invention showing its door in an open position to provide access to a rotatable drum and showing a door latch for holding the door closed in normal operation.

Before the embodiments of the invention are explained in detail, it is to be understood that the invention is not limited in its application to the details of construction and the arrangement of the components set forth in the following description or illustrated in the drawings. The invention is capable of other embodiments and of being practiced or being carried out in various ways. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof.

DETAILED DESCRIPTION OF THE PREFERRED EMBODIMENTS

Referring now to FIG. 1, a dryer 10 may provide a housing 12, typically constructed of sheet-metal, such as enameled sheet steel or the like. The housing 12 may provide a generally box-like outer surface presenting at its upper rear edge dryer controls 14. The dryer controls 14 may communicate with a motor for driving an internal rotating tumbler drum 20 and an air blower (not shown), and with a heater system (not shown) all generally understood in the art. In this way the dryer controls 14 may fully control operation of the dryer 10, for example, according to a drying time set by the consumer.

A front face of the housing 12 may support a door 16 hinging along the vertical axis at one vertical edge of the housing 12 to cover or reveal an opening 18 through which a tumbler drum 20 may be accessed for insertion of wet clothing into the tumbler drum 20. After insertion of clothing into the tumbler drum 20, the door 16 may be closed over tumbler drum 20 to retain the clothes therein. For this purpose, door 16 may provide for a latch element 22 releasably connecting to a corresponding latch element 24 on the front of the housing 12.

These latch elements 22 and 24, as are well understood in the art, may provide for a spring detent retaining the door 16 in a closed position against low forces of impact of clothing agitated by the tumbler drum 20 against the interior of the door 16. The latch elements 22 and 24, however, permit the door 16 to be opened by the consumer at any time during the drying of the clothes by the application of a larger force to the door 16 via the door handle. Latch element 24 may be associated with an electrical switch or a separate electrical switch (not shown) sensing door position and may be used to stop operation of the dryer 10 when the door 16 is in the open state.

Referring still to FIG. 1, the present invention may supplement the latch elements 22 and 24 with a thermally actuated lock 32 that will hold the door 16 in the closed position in the event of a fire in the tumbler drum 20.

Figure 2:
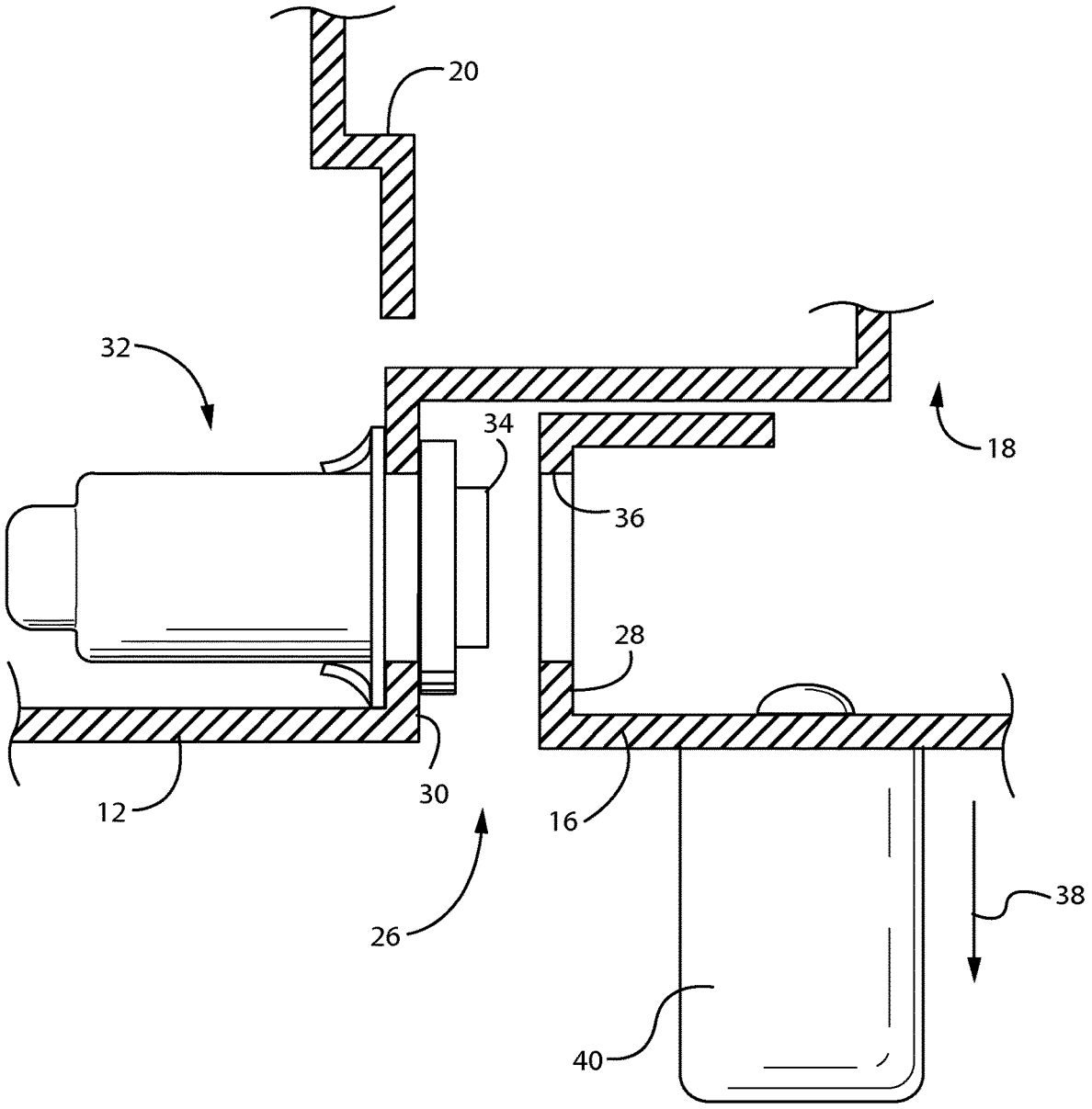
FIG. 2 is a fragmentary cross-section along line 2-2 of FIG. 1 showing positioning of the lock of the present invention to one side of the door when the door is closed.

Referring now to FIGS. 1 and 2, in one embodiment, the door 16 may fit within a recess 26 in the front face of the housing 12 surrounding the opening 18 so that when the door 16 is in a closed position (as shown in FIG. 2) a left vertical lip 28 of the door 16, being generally perpendicular to a broad plane of the door, opposes a corresponding left housing lip 30 surrounding the recess 26, so that the left housing lip 30 is generally parallel to the door lip 28 and offset therefrom. The housing lip 30 may support the thermally actuated lock 32 positioned substantially within the housing 12 but mounted to expose a spring-loaded bolt, such as a plunger bolt 34, so that it may pass through the housing lip 30 in alignment with a corresponding strike hole 36 in the door lip 28. The plunger bolt 34 may thereby be aligned with the strike hole 36 such that extension of the plunger bolt 34 from the housing lip 30 will cause the plunger bolt 34 to pass into the strike hole 36 to engage the hole 36 preventing opening of the door 16 by door handle 40 in the direction of arrow 38. Generally, and as will be described below, in the event of a fire, the thermally actuated lock 32 will release the plunger bolt 34 to thus lock the door 16 in the closed position against opening by the user.

Figure 3:
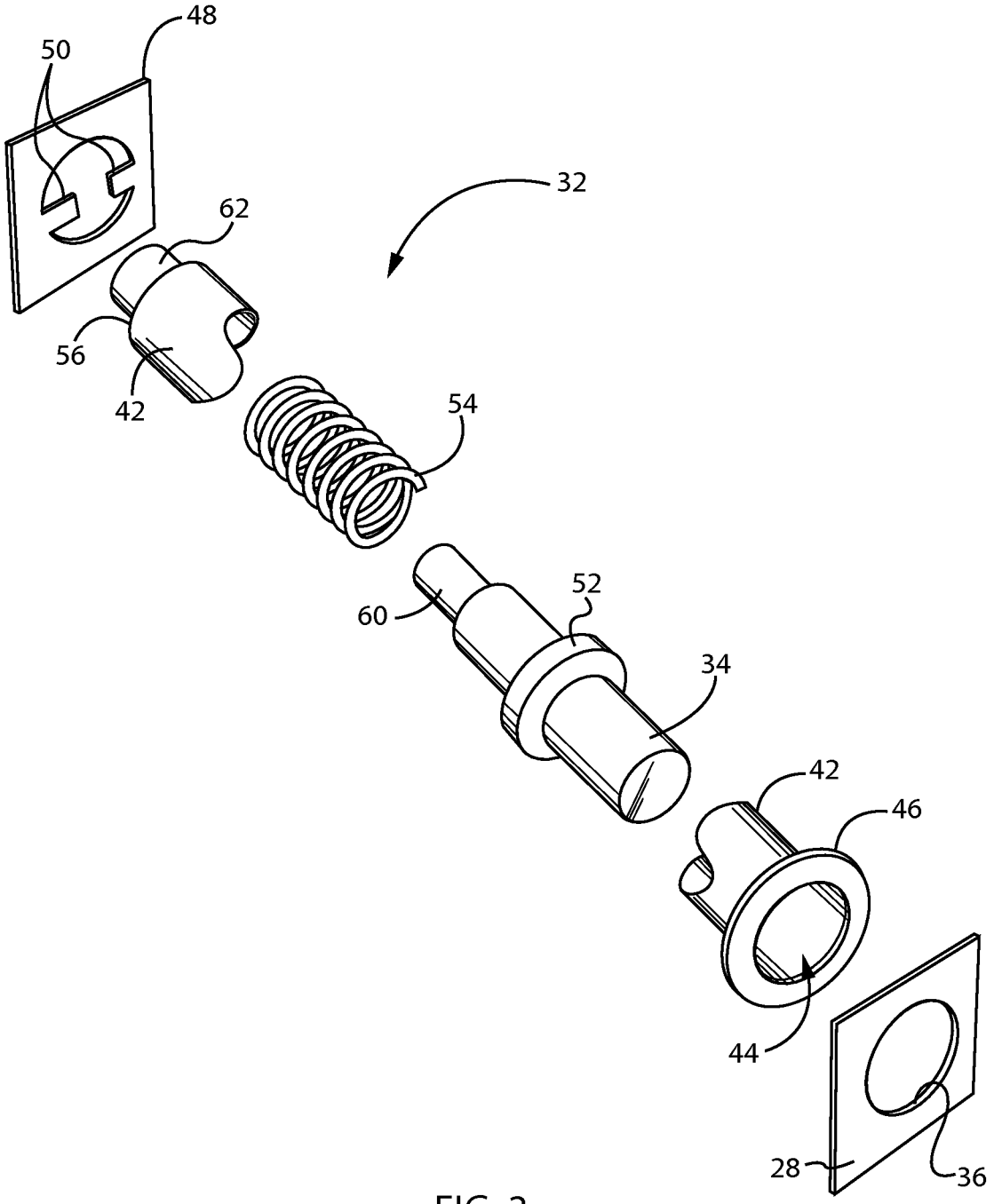
FIG. 3 is an exploded perspective view of the elements of the lock of the present invention (with the housing shown in fragment)
Figure 4:
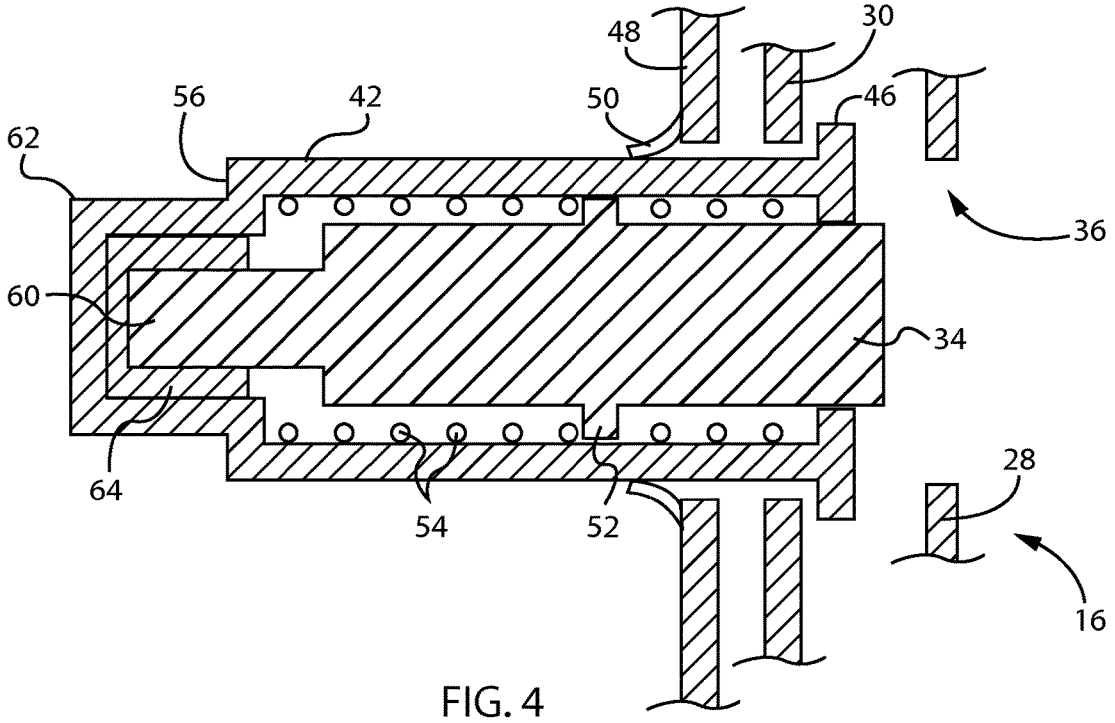
FIG. 4 is an elevational cross-section through the lock of the present invention in a ready state during normal operation of the dryer.

Referring now to FIGS. 2, 3 and 4, the thermally actuated lock 32 in one embodiment may provide a generally tubular and cylindrical housing 42 having an opening 44 at a first end surrounded by a radially extending flange 46. The cylindrical housing 42 may fit within a hole in the housing lip 30 with the flange 46 resting against an outer surface of the housing lip 30 preventing further movement of the housing 42 into the housing 12. A retainer element or clip, such as a metal clip or metallic spring clip 48, may slide over the tubular form of the housing 42 on the inside of the housing 12 toward the flange 46 to retain the housing 42 against the housing lip 30 by sandwiching the housing lip 30 between the spring clip 48 and the flange 46.

The spring clip 48 in this regard may include spring-biased cantilevered teeth 50 extending inward about a hole in the spring clip 48 otherwise sized to receive the cylindrical housing 42. The cantilevered teeth 50 angle rearward to wedge against the outer surface of the housing 42 to prevent the spring clip 48 from slipping backward away from the flange 46 once it has been so installed. It is contemplated that the spring clip 48 may be replaced with other types of retainer elements known in the art and capable of retaining the housing 42 against the housing lip 30 including, for example, nut engaging threads in the outer surface of the cylinder housing 42 or rivets through flange 46 into the housing lip 30.

The flange 46 and spring clip 48 allow rapid installation of the thermally actuated lock 32 by sliding the housing 42 into a pre-existing mounting hole and retaining it by sliding the spring clip 48 upward along the barrel of the housing 42.

A cylindrical bolt 34 may fit within the housing 42 and includes between its ends a radially extending flange 52 sized to be received slidably within the housing 42 with the flange 52 closely abutting the interior surface of the cylindrical housing 42. In order to provide suitable strength in the event of a fire, the bolt 34 may be fabricated of a metal material and may have a diameter greater than 0.25 inches or greater than 0.5 inches to provide sufficient lateral resistance against forces opening the door and provide sufficient resistance against deformation in high fire temperatures. Alternatively, the bolt 34 may have a thickness measured across the axis of extension of the bolt greater than 0.02 inches or greater than 0.06 inches. In this latter regard, the bolt 34 may be a solid material; however, hollow or tubular constructions are also contemplated.

The flange 52 may abut one end of a helical compression spring 54 also fitting within the housing 42 coaxially around a remainder of the cylindrical bolt 34 on the side of the flange 52 removed from the opening 44 of the housing 42. An opposite end of the spring 54 rests against inwardly extending rim 56 of the housing 42 at a second end of the housing 42 removed from the opening 44 such as forms a base. A normal compression of the spring 54 between the base rim 56 and the flange 52 causes a spring biasing of the bolt 34 outward from the opening 44 into a state of engagement with the hole 36 in the door lip 28 absent other restraint. It will be appreciated that other types of springs may be used in lieu of the compression spring 54 including, for example, an extension spring positioned on the opposite side of the flange 52.

A rear portion of the bolt 34 away from the opening 44 provides an axially extending boss 60 fitting within a corresponding socket 62 formed in the rear of the housing 42. This boss 60 has a smaller diameter than the diameter of the remainder of the bolt 34 in the socket 62 and may have a reduced inner diameter with respect to the remainder of the housing 42. When the bolt 34 is fully retracted into the housing 42, the boss 60 is held within the socket 62 by a fusible material 64 such as a solid metal alloy such as a solder having a melting point above normal operating temperatures of the dryer as communicated to the socket 62 but below a temperature experienced by the socket 62 corresponding to an internal fire within the dryer 10. The reduced size of the boss 60 and socket 62 serve to reduce the necessary amount of fusible material 64 allowing it to melt faster and reducing the cost of the thermally actuated lock 32. Other melting or ablative materials may be used in lieu of the metal alloy including polymer materials to provide the fusible material 64. Generally it is contemplated that the fusible material will melt in a range of temperatures above the normal temperature range of dryers indicating a fire. The normal temperature of dryers typically range from about 120-140 degrees Fahrenheit. Accordingly the fusible material 64 may have a melting temperature of substantially 170 degrees or higher or alternatively substantially 190 degrees or higher. Temperatures above these limits indicate abnormal temperatures within the dryer drum and possible fire. Alternatively, lower fusing temperatures may be used by providing thermal shielding between the possible source of fire and the housing 42. Possible fusible materials 64 include Rose's metal being an alloy of bismuth, lead and tin.

Figure 5:
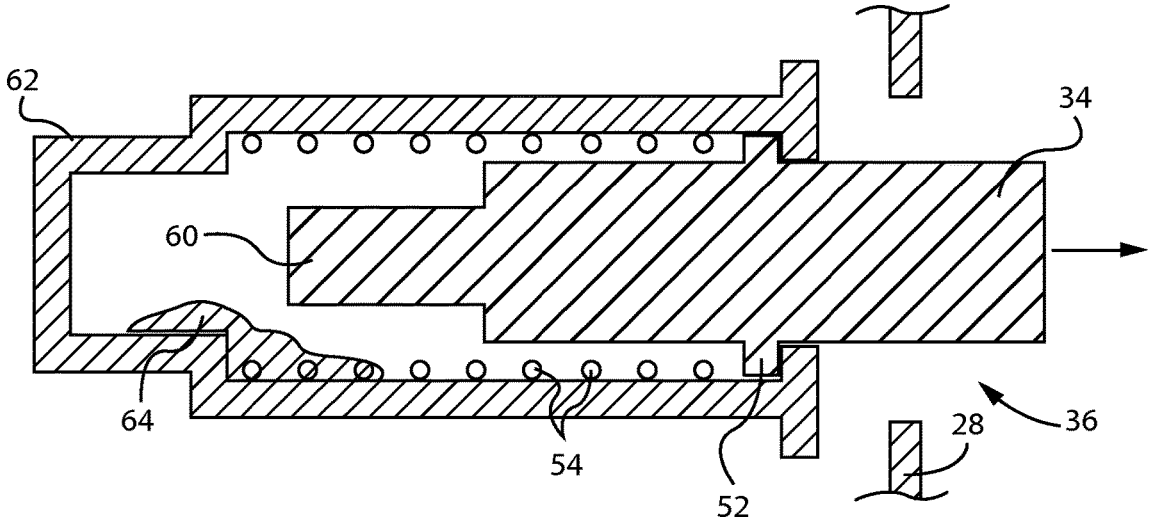
FIG. 5 is a figure similar to that of FIG. 4 showing the lock of the present invention in a released state upon the occurrence of elevated temperatures associated with the fire.

Referring to FIG. 5, high temperatures that will cause a melting of the solid alloy material 64 release the boss 60 from the socket 62 and allow the bolt 34 to extend outward through the hole 36 under the force of the spring 54 locking the door 16 while it is closed. Engagement between the bolt 34 and the strike hole 36 is limited by an abutment of the flange 52 within the inner lip at the open end of the housing 42. Preferably the locking process is irreversible, preventing opening of the dryer 10 even after the fire has been extinguished from lack of additional air or has fully consumed the combustible material. Generally, the components of the bolt 34, the housing 42 and the spring 54 will be high-temperature materials, such as steel or high temperature metals, capable of resisting melting at fire temperatures.

It will be appreciated that the thermally actuated lock 32 of the present invention may be positioned in a variety of locations on the dryer 10 that will serve to hold the dryer door 16 closed and may be used in other appliances in which a fire hazard may be mitigated by holding a door closed, for example a microwave oven.

Figure 6:
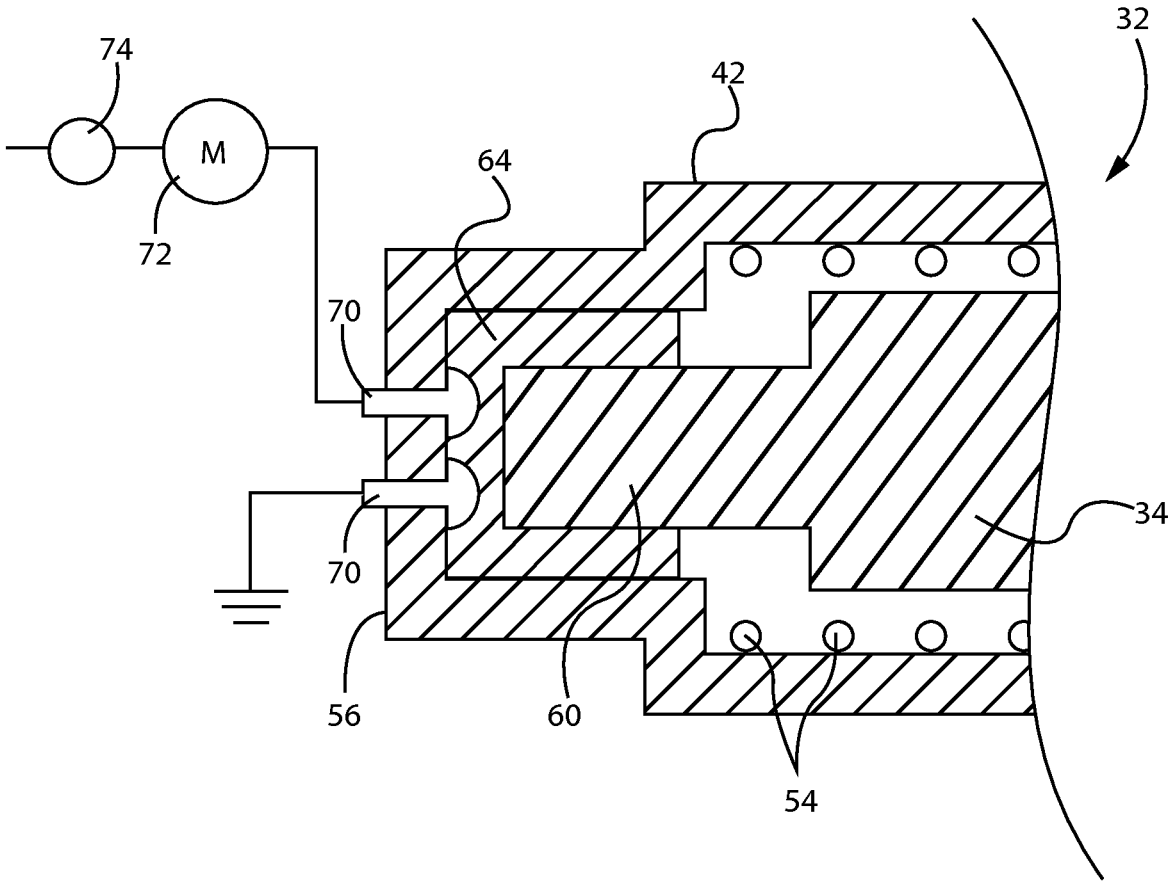
FIG. 6 is a fragmentary cross-section similar to FIG. 4 showing the addition of an electrical switch signaling activation of the lock of the present invention.

Referring now to FIG. 6, in an alternative embodiment, movement of the bolt 34 may actuate a set of electrical contacts providing information, to the dryer controls with respect to its activation, for example, to shut down dryer operations. In another embodiment, movement of the bolt 34 may disrupt a set of electrical contacts providing activation of dryer operations, causing the dryer to shut down.

Referring to FIG. 6, in an alternative embodiment, the thermally actuated lock 32 may provide for a pair of conductive metal studs 70 protruding into a conductive metallic fusible material 64 to be electrically shorted by this fusible material 64. When fusible material 64 is in a solid state, the bolt 34 is in a retracted position and the fusible material 64 provides a closed electrical circuit through the studs 70, for example, providing for electrical conduction through a motor 72 of the appliance providing movement of the tumbler from the drying fan as well as electrical heater control 74, for example a gas valve or electrical heating element. Melting of the fusible material 64 causes it to flow away from the studs 70 opening that circuit.

Various features of the invention are set forth in the following claims. It should be understood that the invention is not limited in its application to the details of construction and arrangements of the components set forth herein. The invention is capable of other embodiments and of being practiced or carried out in various ways. Variations and modifications of the foregoing are within the scope of the present invention. It also being understood that the invention disclosed and defined herein extends to all alternative combinations of two or more of the individual features mentioned or evident from the text and/or drawings. All of these different combinations constitute various alternative aspects of the present invention. The embodiments described herein explain the best modes known for practicing the invention and will enable others skilled in the art to utilize the invention.

What is claimed is:

1. A dryer comprising:

a dryer housing holding a tumbler drum having an interior receiving clothes to be dried, a motor for rotating the tumbler drum, and a heater system providing temperatures in excess of 120 degrees Fahrenheit;

a dryer door hingeably attached to the dryer housing at a hinge side to move between an open position providing access by a user to the interior of the tumbler drum by a swinging outward of a free side of the dryer door opposite the hinge side and a closed position blocking access by the user to the interior of the tumbler drum by a swinging inward of the free side of the dryer door against the dryer housing;

a latch providing a spring detent holding the dryer door in the closed position against forces of impact of clothing agitated by the tumbler drum against an interior of the dryer door but movable to the open position by force solely on the dryer door by the user greater than the forces of impact; and a lock assembly independent from the latch and attached to one of the dryer housing and the dryer door and operating between the free side of the dryer door and the dryer housing proximate to the dryer door in the closed position and including:

(a) a spring-loaded bolt comprising a spring and a bolt movable between a disengaged position and an engaged position, to allow moving the dryer door to the open position when the spring-loaded bolt is in the disengaged position by the user of the dryer and to irreversibly block opening of the dryer door by the user in response to a spring biasing in the engaged position; and (b) a fusible material operating when solid to hold the spring-loaded bolt in the disengaged position and thermally communicating with the interior of the tumbler drum to melt in the event of a dryer fire causing the spring-loaded bolt to move to the engaged position and be retained by the spring preventing access by the user to the interior of the tumbler drum during and after the dryer fire;

wherein the fusible material is a metal alloy.

2. The dryer of claim 1 wherein the lock assembly is attached to the dryer housing so that the spring-loaded bolt may extend outward into a strike hole in the dryer door.

3. The dryer of claim 2 wherein the spring-loaded bolt has a thickness greater than 0.02 inches and the strike hole is substantially equal to the spring-loaded bolt thickness.

4. The dryer of claim 1 further comprising a bolt housing received within a hole through a sheet-metal surface of the dryer housing and wherein the bolt housing has a radially extending flange surrounding the hole at a first end of the bolt housing and adapted to be retained against an outer rim of the hole.

5. The dryer of claim 4 further comprising a retainer clip fitting over an outer surface of the bolt housing to slide toward the outer rim of the hole to retain the bolt housing attached to the dryer housing with the outer rim of the hole flanked on opposite surfaces by the radially extending flange and the retainer clip.

6. The dryer of claim 5 wherein the retainer clip is a metal clip having spring-biased cantilevered teeth canted to allow the retainer clip to slide over the outer surface of the bolt housing toward the outer rim of the hole but to resist sliding over the outer surface of the bolt housing away from the outer rim of the hole.

7. The dryer of claim 1 further including an electrical switch activated with movement of the spring-loaded bolt to shut down a fan of the dryer.

8. The dryer of claim 1 wherein the spring is a compression spring fitting coaxially around the bolt.

9. The dryer of claim 1 wherein the fusible material melts into a liquid in the event of the dryer fire.

10. The dryer of claim 1 further including a bolt housing defining a single volume holding the spring-loaded bolt and holding the fusible material within the bolt housing.

11. A method of locking a dryer door of a dryer in the event of fire, the dryer door hingeably attached to a dryer housing at a hinge side to move between an open position providing access by a user to an interior of a tumbler drum receiving clothes to be dried by a swinging outward of a free side of the dryer door opposite the hinge side and a closed position blocking access by the user to the interior of the tumbler drum by a swinging inward of the free side of the dryer door against the dryer housing, a motor for rotating the tumbler drum and a heater system providing temperatures in excess of 120 degrees Fahrenheit and a latch providing a spring detent holding the dryer door in the closed position against forces of impact of clothing agitated by the tumbler drum against an interior of the dryer door but movable to the open position by force solely on the dryer door by the user greater than the forces of impact, the method of locking being through the use of a dryer lock attached to one of the dryer housing and the dryer door and operating between the free side of the dryer door and the dryer housing proximate to the dryer door in the closed position and having:

a housing having an opening at a first end and a base at a second end;

a bolt slidably received within the housing to move between an extended position where the bolt protrudes out from the opening to irreversibly block opening of the dryer door by the user, and a retracted position where the bolt is substantially fully received within the housing to allow moving the dryer door to the open position when the bolt is in the disengaged position by the user of the dryer;

a spring biasing the bolt toward the extended position; and a fusible material operating in a solid state to join the bolt to the housing when the bolt is in the retracted position;

wherein the fusible material is a metal alloy that has a melting point of above 170 degrees Fahrenheit; wherein the method comprises the steps of:

(1) installing the dryer lock independent from the latch in one of the dryer door and the dryer housing with the bolt in the retracted position so as not to engage between the dryer housing and the dryer door (2) during a normal operation of the dryer, opening and closing the dryer door without engagement of the bolt between the dryer housing and the dryer door;

(3) during a fire in the tumbler drum, melting the fusible material to cause the bolt to extend into engagement between the dryer housing and the dryer door as retained by the spring to prevent the dryer door from opening by the user during and after the fire.

12. The method of claim 11 wherein step (1) inserts the housing through a hole through sheet-metal of the dryer housing until a radially extending flange on the housing surrounding the hole at the first end of the bolt abuts an outer rim of the hole toward the dryer door of the dryer in the closed position.

13. The method of claim 12 further including the step of sliding a retainer clip fitting over an outer surface of the housing toward the outer rim of the hole to retain the housing attached to the dryer housing with the outer rim of the hole flanked on opposite surfaces by the radially extending flange and the retainer clip.

* * * * *